US005302162A

United States Patent [19]

Pasero

[11] Patent Number: 5,302,162

[45] Date of Patent: Apr. 12, 1994

[54] EXERCISE TREADMILL WITH TENSION-LIMITED BELT ADJUSTMENT

[75] Inventor: Peter A. Pasero, Renton, Wash.

[73] Assignee: Precor Incorporated, Renton, Wash.

[21] Appl. No.: 972,002

[22] Filed: Nov. 5, 1992

[51] Int. Cl.[5] ..... A63B 22/02

[52] U.S. Cl. ..... 482/54; 482/908; 198/814

[58] Field of Search ..... 482/52, 54, 62, 70, 482/71, 908; 198/814

[56] References Cited

U.S. PATENT DOCUMENTS

| | | | |
|---|---|---|---|
| Re. 9,135 | 3/1880 | Parr . | |
| 1,766,089 | 6/1930 | Wood . | |
| 2,179,187 | 11/1939 | Kendall . | |
| 2,315,485 | 4/1943 | Jones, 3d . | |
| 2,541,080 | 2/1951 | Lyon . | |
| 2,569,673 | 10/1951 | Johnson et al. . | |
| 2,725,975 | 12/1955 | Franz . | |
| 2,753,039 | 7/1956 | Velten et al. | 158/814 |
| 2,895,593 | 7/1959 | McKnight et al. . | |
| 2,973,084 | 2/1961 | Sinden et al. . | |
| 3,018,875 | 1/1962 | Greenberger . | |
| 3,039,597 | 6/1962 | Merchant . | |
| 3,118,315 | 1/1964 | Loosli . | |
| 3,189,165 | 6/1965 | Theijsmeijer . | |
| 3,832,910 | 9/1974 | Bryant . | |
| 3,921,793 | 11/1975 | Hutchinson et al. . | |
| 3,941,377 | 3/1976 | Lie . | |
| 4,151,988 | 5/1979 | Nabinger . | |
| 4,374,587 | 2/1983 | Ogden . | |
| 4,561,538 | 12/1985 | Zwiebel . | |
| 4,566,689 | 1/1986 | Ogden | 482/54 |
| 4,602,779 | 7/1986 | Ogden . | |
| 4,803,804 | 2/1989 | Bryant . | |
| 4,967,669 | 11/1990 | Kuchta . | |
| 5,009,168 | 4/1991 | Kuchta . | |
| 5,030,173 | 7/1991 | Bryant . | |
| 5,054,608 | 10/1991 | Bryant . | |

FOREIGN PATENT DOCUMENTS

| | | | |
|---|---|---|---|
| 196877 | 10/1986 | European Pat. Off. . | |
| 3619771 | 12/1987 | Fed. Rep. of Germany | 198/814 |
| 3619771A | 12/1987 | Fed. Rep. of Germany | A01D 90/12 |
| 2467000 | 5/1981 | France . | |
| 1399906 | 10/1971 | U.S.S.R. | 198/814 |
| 1640064 | 4/1991 | U.S.S.R. | 198/814 |

*Primary Examiner*—Richard J. Apley
*Assistant Examiner*—Jeanne M. Mollo
*Attorney, Agent, or Firm*—Christensen, O'Connor, Johnson & Kindness

[57] ABSTRACT

A treadmill (10) includes a frame (12) on which are rotatably mounted first and second roller assemblies (14, 16) on axles (40, 48) disposed on spaced apart transverse axes (42, 50). An endless belt (18) is trained about the roller assemblies. A ratcheting bolt assembly (52) is rotatably secured to the frame and is engaged with one end of the second roller assembly (16) to enable adjustment of the tension in the belt. The ratcheting bolt assembly has a threaded end portion (74) that is threadably engaged with one end of the axle on which the second roller assembly is mounted. The ratcheting bolt assembly includes a ratcheting head (80) that is graspable to rotate the adjustment bolt assembly for threadably advancing the axle on the threaded end portion of the adjustment bolt assembly, thereby changing the distance between the first and second roller assemblies and adjusting the tension in the belt. The ratcheting head ratchets on the adjustment bolt assembly to prevent an increase in the belt tension in excess of a predetermined maximum belt tension.

16 Claims, 5 Drawing Sheets

EXERCISE TREADMILL WITH TENSION-LIMITED BELT ADJUSTMENT

FIELD OF THE INVENTION

The present invention relates to exercise apparatus, and more particularly, to mechanisms for adjusting the tension in exercise treadmill belts.

BACKGROUND OF THE INVENTION

Treadmills have become popular in recent years for both home and office use to enable exercisers to run indoors in small confines. Most exercise treadmills include first and second roller assemblies rotatably mounted across opposite ends of a frame. Each roller assembly includes a cylindrical roller that is journaled on an axle or opposing stub shafts, with the axle or stub shafts being secured to opposite sides of the treadmill frame. A belt is then trained about the roller assemblies. The distance between the first and second roller assemblies determines the tension in the treadmill belt. The tension in the treadmill belt is initially set to provide a firm footing for the exerciser without slack that could result in injury to the exerciser, and to prevent undesirable side-to-side movement of the belt on the roller assemblies.

Over time with repeated usage, the bearings on which the rollers are journaled tend to wear, and the belt material may stretch. In order to initially set the treadmill belt tension and to later enable adjustment for this wear, many treadmills include an adjustment mechanism whereby the position of one of the roller assemblies can be adjusted relative to the frame and the other roller assembly by the exerciser. In some conventional models, this mechanism may include a bolt that is longitudinally disposed and rotatably mounted on the frame, and that has a threaded end that is engaged within a threaded cross-hole formed through one end of the roller assembly axle. Rotation of the bolt results in movement of that end of the axle along the length of the bolt, changing the distance between the roller assembly axles. The other end of the axle may also be adjustably mounted to the frame with a similar adjustment bolt to enable the roller assemblies to be maintained in parallel relationship.

A drawback of such conventional treadmill belt tensioning adjustment mechanisms is that the exerciser may inadvertently or purposefully overtighten the belt by drawing the axles too far apart from each other. This can result in excessive wear of the belt and the roller bearings, shortening the life of the treadmill.

SUMMARY OF THE INVENTION

The present invention provides an exercise treadmill with tension-limited belt adjustment. The treadmill includes a frame, first and second roller assemblies mounted on axles to the frame to rotate about first and second spaced transverse axes, and an endless belt trained about the first and second roller assemblies. The treadmill further includes an adjustment mechanism for adjusting tension in the belt, wherein the adjustment mechanism includes a limiting device for automatically limiting operation of the adjustment mechanism when a predetermined maximum belt tension is reached.

In a preferred embodiment of the present invention, the adjustment mechanism comprises a ratcheting bolt assembly. The ratcheting bolt assembly includes a threaded end portion and a ratcheting head. The adjustment bolt assembly is rotatably secured to the frame. The threaded end portion of the adjustment bolt assembly is threadably engaged with an axle on which one of the roller assemblies is mounted. The ratcheting head of the adjustment bolt assembly is graspable to rotate the adjustment bolt assembly and threadably advance the axle on the threaded end portion of the adjustment bolt assembly. This adjustment results in a change in the distance between the first and second roller assemblies (and thus the first and second axes on which the roller assemblies are mounted) thereby adjusting the tension in the belt. However, the ratcheting head ratchets on the adjustment bolt assembly to prevent movement of the roller assembly that would result in an increase in the tension of the belt in excess of a predetermined maximum belt tension.

The present invention provides a mechanism for adjusting the tension in a treadmill belt, while limiting the degree of adjustment possible, to prevent inadvertent or purposeful overtensioning of the belt. Thus, undesirable wear of the belt and roller assembly bearings is avoided, extending the life of the treadmill.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
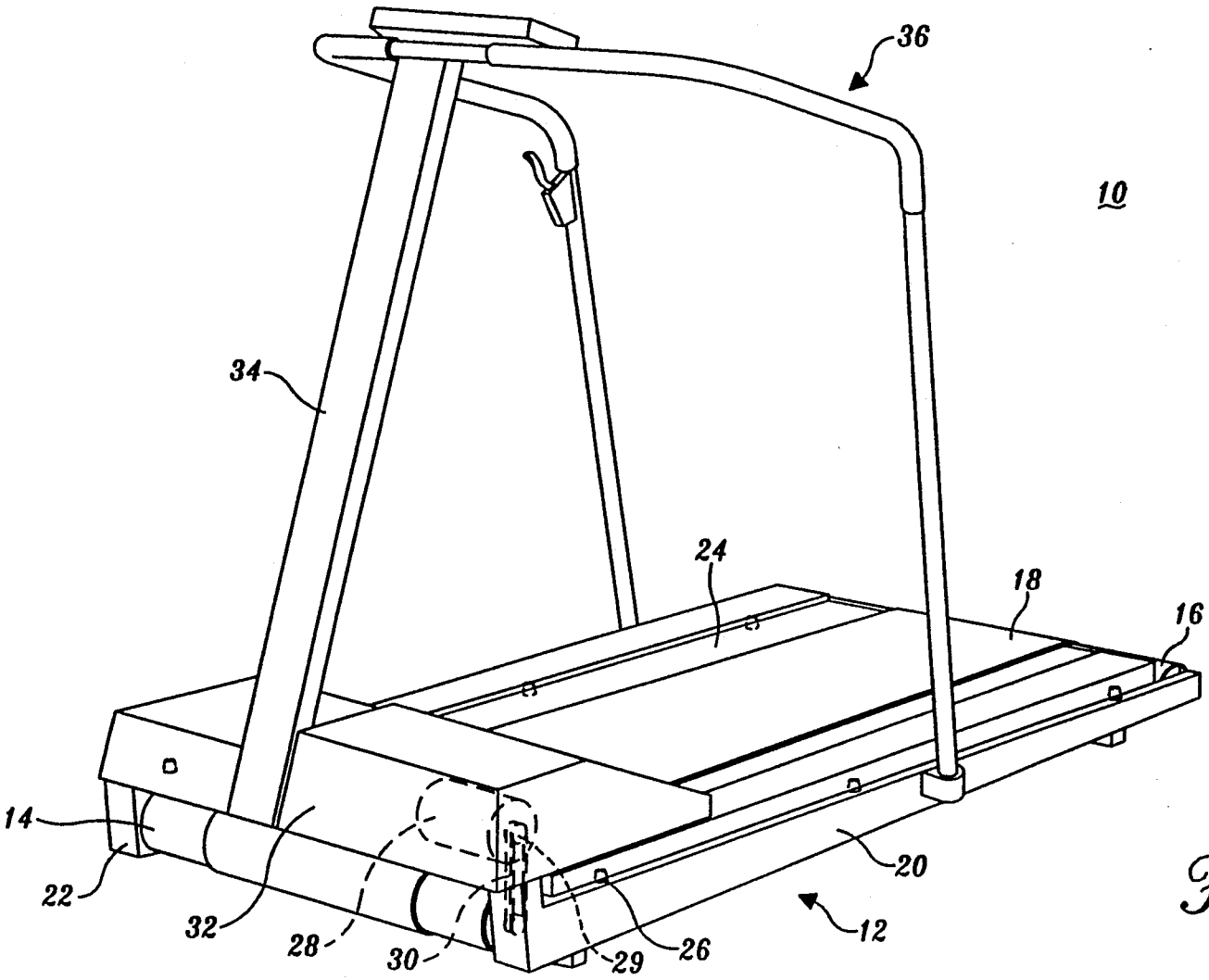
FIG. 1 provides a pictorial view of a treadmill constructed in accordance with the present invention.

A treadmill 10 constructed in accordance with the present invention is shown in FIG. 1. The treadmill 10 includes a frame 12 on opposite ends of which are transversely mounted a forward roller assembly 14 and a rear roller assembly 16. An endless belt 18 is trained about the forward roller assembly 14 and rear roller assembly 16. The treadmill 10 further includes an adjustment mechanism, to be described subsequently, for adjusting tension in the belt 18. The adjustment mechanism is constructed to automatically limit further increasing of the tension in the belt 18 in excess of a predetermined maximum belt tension.

Figure 2:
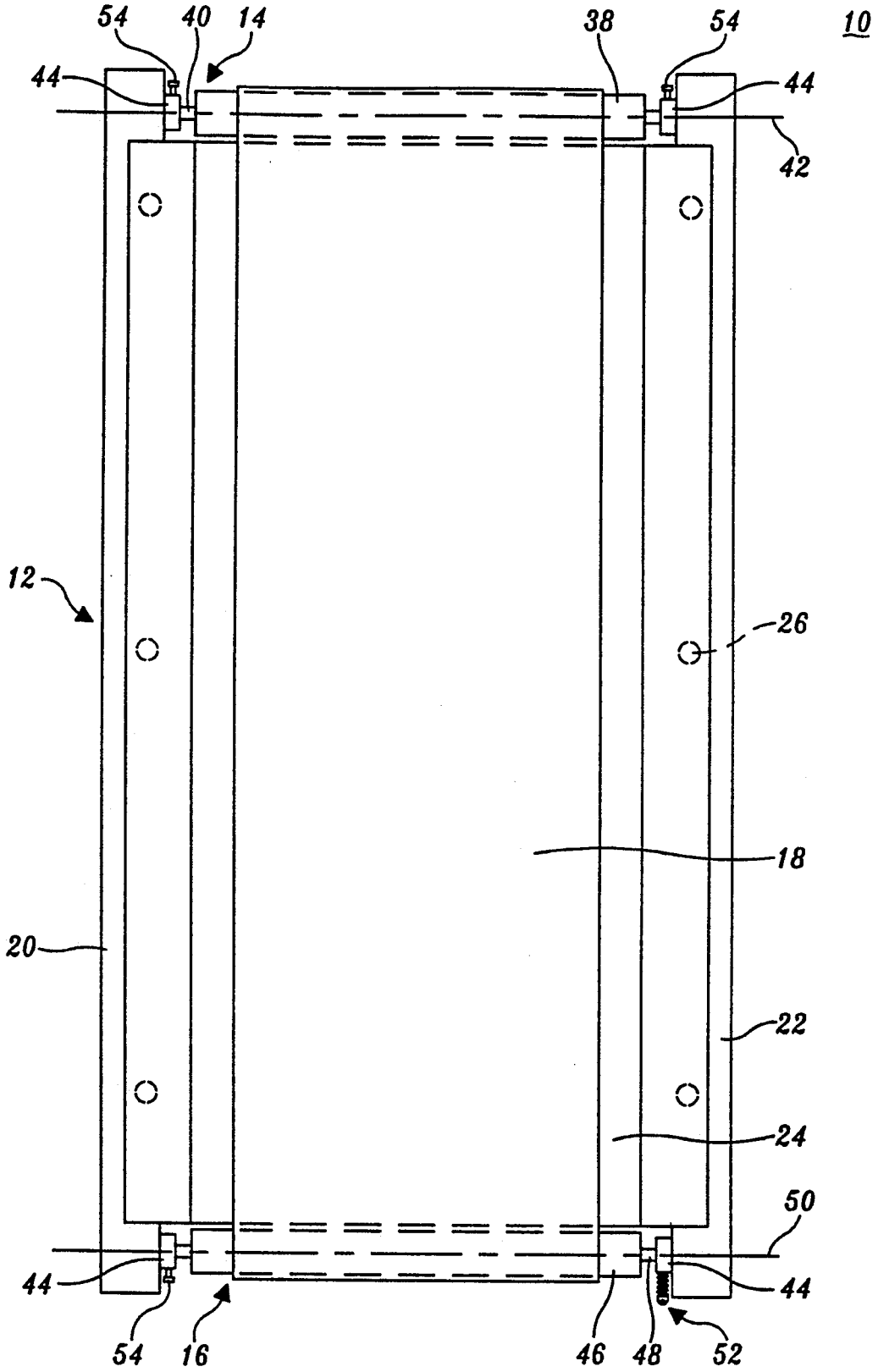
FIG. 2 provides a top view of the treadmill of FIG. 1, with the motor housing, motor, and railing removed for clarity.

Referring to FIGS. 1 and 2, the frame 12 includes first and second longitudinal siderail members 20 and 22. The siderail members 20 and 22 are spaced apart and are joined by cross members (not shown), as is well known for treadmill frame construction. A rigid deck 24 spans between and is supported above the first and second frame siderail members 20 and 22. A plurality of elastomeric springs 26 are disposed between the deck 24 and the siderail members 20 and 22 to provide impact absorption. The endless belt 18 is preferably made of a flexible material, such as a rubber impregnated fabric. When installed about the front roller assembly 14 and rear roller assembly 16, the upper run of the belt 18 is supported by the deck 24. As used herein throughout, "forward" refers to the direction in which an exerciser faces when using the treadmill. The terms "rear" and "rearward" refer to the opposite direction.

The treadmill 10 further includes a motor 28 having a drive shaft 29 engaged by a drive belt 30 with a drive pulley (not shown) mounted on one end of the forward roller assembly 14, as in conventional treadmills. The motor 28 is housed within a cover 32. The frame 12 further includes an upright member 34 projecting upwardly from the forward end of the frame 12, which supports the center of a contoured railing 36 that is graspable by an exerciser running on the treadmill. The railing 36 extends downwardly on either side, terminating at and secured to the siderail members 20 and 22. The motor 28 drives rotation of the forward roller assembly 14, thus causing movement of the treadmill belt 18 on which an exerciser strides during use of the treadmill 10. The forward roller assembly 14 thus serves as the drive roller, while the rear roller assembly 16 serves as the takeup roller.

Referring to FIG. 2, the forward roller assembly 14 includes a cylindrical roller shell 38 rotatably mounted on bearings (not shown) on an axle 40. The axle 40 is disposed transversely relative to the longitudinal frame members 20 and 22 on a forward axis 42, between the forward ends of the frame siderail members 20 and 22. Each end of the axle 40 is adjustably mounted within a mounting block 44 secured to the inside of the corresponding siderail member 20 or 22, as shall be described more fully subsequently. As used herein throughout, the term "axle" is intended to include not only unitary axles, but also opposing stub shafts.

The rear roller assembly 16 likewise includes a roller shell 46 that is mounted on bearings (not shown) on a transverse rear axle 48. The rear axle 48 is mounted parallel to the forward axle 40, between the rear ends of the frame siderail members 20 and 22, on a rear axis 50. The ends of the rear axle 48 are mounted to the inside of the ends of the rear frame siderail members 20 and 22 within additional mounting blocks 44, similarly to the ends of the forward axle 40. The roller assemblies 14 and 16 thus rotate about transverse, spaced-apart, parallel axes 42 and 50, respectively.

Each of the mounting blocks 44 includes a mechanism for enabling adjustment of the positioning of the corresponding axle end within the mounting block 44 along the longitudinal dimension of the frame. However, the mounting block 44 mounted on the inside of the rear end of the frame siderail member 22 carries a ratcheting bolt assembly 52 to allow adjustment of the position of that end of the axle 48 within the mounting block 44, while each of the remaining three mounting blocks 44 includes a conventional adjustment bolt 54. The operation and construction of the ratcheting bolt assembly 52 shall now be described, with the operation of the bolts 54 described thereafter.

Figure 3:
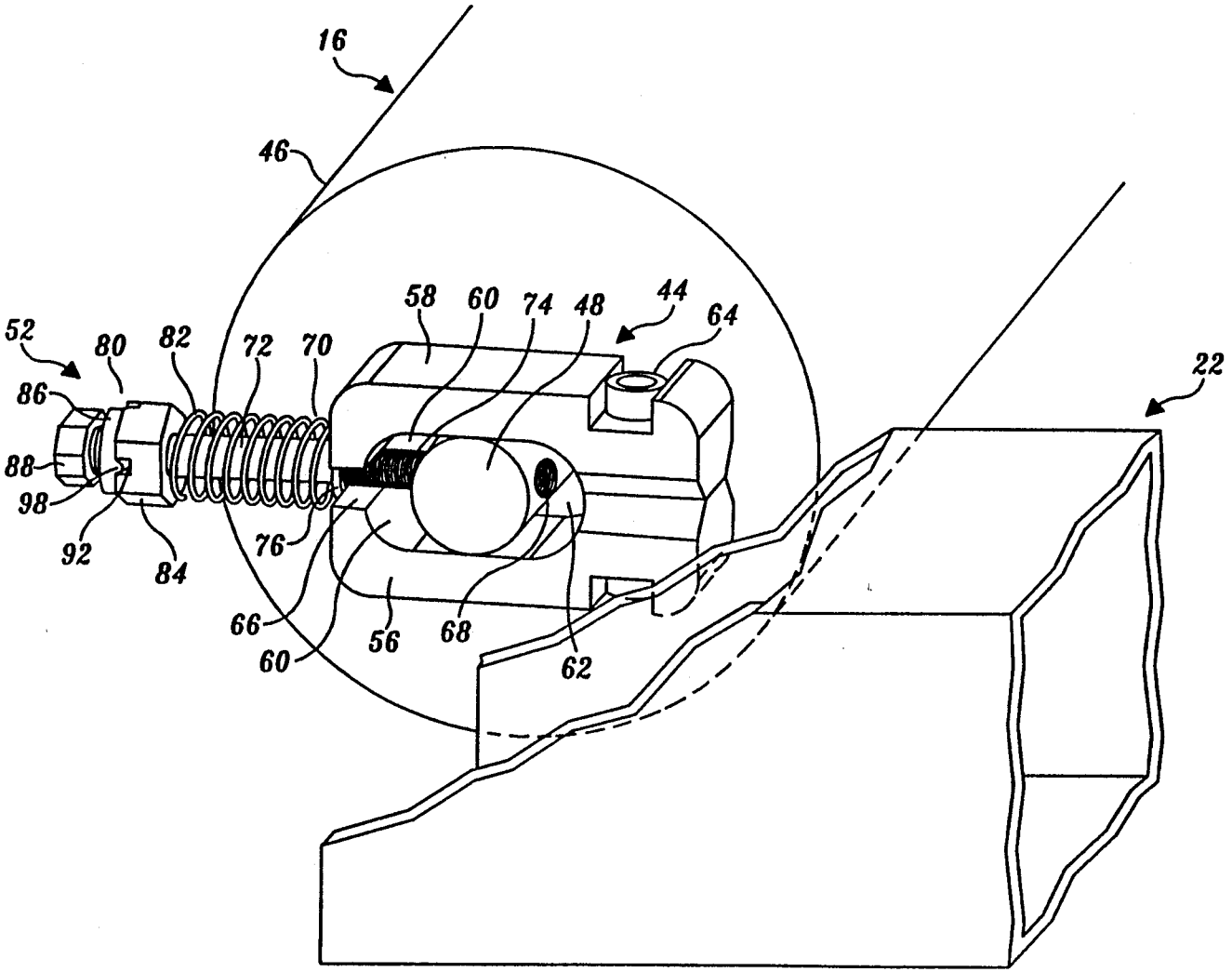
FIG. 3 provides an end view of the tension-limited adjustment mechanism of the present invention mounted on the treadmill frame and engaged with one end of a roller assembly, with a portion of the frame siderail member cut away for clarity.

Referring to FIG. 3, the mounting block 44 is constructed from opposing lower and upper guide members 56 and 58. The lower guide member 56 has an upwardly opening, elongate C-shaped configuration, its upper surface defining an elongate recess 60. The upper guide member 58 is identically configured, but is mated upside down on top of the lower guide member 56. The elongate recesses 60 of the mated guide members 56 and 58 thus define a longitudinally oriented (relative to the frame 12) inner slot 62. The lower guide member 56 and the upper guide member 58 are clamped together by means of a bolt 64. The lower guide member 56 is fixedly secured by welding or another conventional method to the inner surface of the rear end of the frame siderail member 22.

An outer slot 66 is formed through the rear side of the joined lower guide member 56 and upper guide member 58, and extends into the inner slot 62. The inner slot 62 is wider than the outer slot 66. The end of the axle 48 is received within the slot 62 of the mounting block 44, thereby mounting the axle 48 to the frame 12. The axle 48 is slidable within the slot 62, allowing movement of the end of the axle 48 in the longitudinal direction, i.e., along the length of the frame siderail member 22. The width of the inner slot 62 substantially matches the diameter of the axle 48, while the outer slot 66 has a lesser width to avoid escape of the axle 48 from the inner slot 62. A threaded aperture 68 is formed crosswise through the end of the axle 48. The axis of the aperture 68 is longitudinally oriented, parallel with the frame siderail member 22 and the slot 62.

Figure 4:
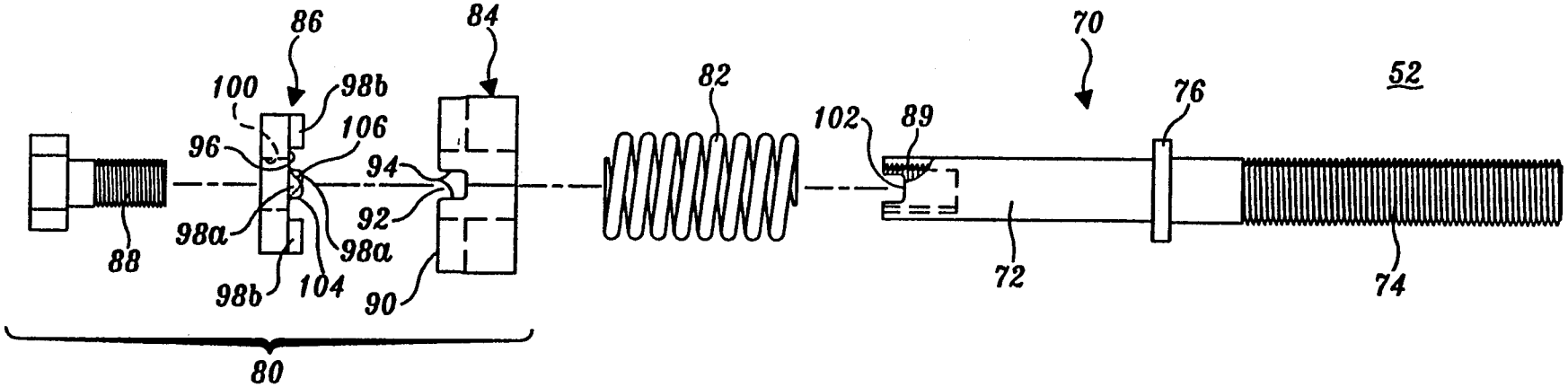
FIG. 4 provides an exploded side elevation view of the bolt assembly of the present invention.

Referring to FIGS. 3 and 4, the ratcheting bolt assembly 52 includes an elongate shaft 70. The elongate shaft 70 has a non-threaded shank portion 72 and a threaded portion 74. An annular flange 76 is formed about the shaft 70 and separates the non-threaded shank portion 72 from the threaded portion 74.

Referring to FIG. 3, the threaded portion 74 of the shaft 70 is slidably inserted through the outer slot 66 in the rear end of the mounting block 44 and passes into the inner slot 62 therein. The threaded portion 74 of the shaft 70 is then threadably engaged within the threaded aperture 68 of the axle 48. Rotation of the shaft 70 results in threadable advancement of the axle 48 in either direction along the length of the shaft 70. Rotation of the shaft 70 in the clockwise direction results in the axle 48 moving in the rearward direction, i.e., toward the outer slot 66 of the mounting block 44. This causes the rear roller assembly 16 to move away from the forward roller assembly 14, thereby tightening, i.e., increasing the tension in, the belt 18. When the belt 18 is under tension, the annular flange 76 of the shaft 70 bears against the rearward face of the mounting block 44.

The ratcheting bolt assembly 52 includes a ratchet head 80 that is graspable for rotation of the shaft 70, but which prevents further clockwise rotation of the shaft 70 once a desired maximum tension in the belt 18 is reached. Referring to FIGS. 3 and 4, a coil compression spring 82 is received axially on the non-threaded shank portion 72 of the shaft 70. A non-threaded annular nut 84 is then axially inserted onto the non-threaded shank portion 72 of the shaft 70, so that the spring 82 is sandwiched between the nut 84 and the annular flange 76. An annular ratchet cap 86 is positioned on the outside of, and axially aligned with, the installed nut 84. The threaded length of a standard cap screw 88 is slidably inserted through the center of the annular ratchet cap 86, and is threadably received within an internally threaded central passage 89 formed longitudinally into the end of the non-threaded shank portion 72 of the shaft 70. When the cap screw 88 is fully inserted into the passage 89, the ratchet cap 86 is sandwiched between the head of the cap screw 88 and the nut 84. The spring 82 is partially compressed between the nut 84 and the annular flange 76 of the shaft 70.

Figure 6:
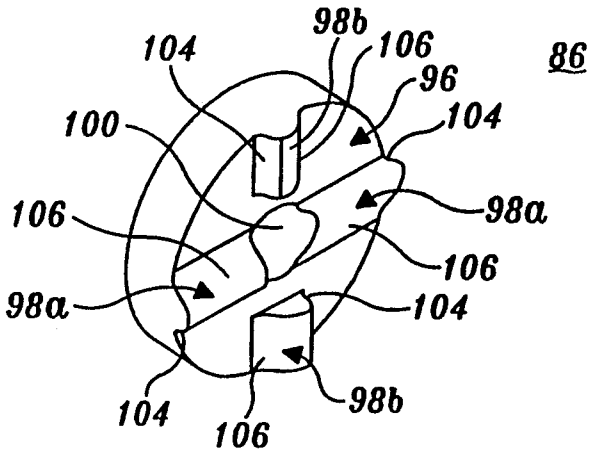
FIG. 6 provides a pictorial view of the ratchet cap of the ratcheting bolt assembly of FIG. 4.
Figure 5:
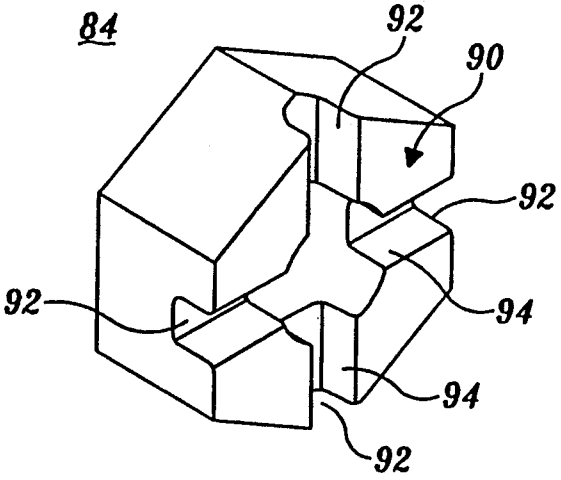
FIG. 5 provides a pictorial view of the ratchet nut included on the ratcheting bolt assembly of FIG. 4.

Referring to FIG. 5, the outer (rearward) facing side of the nut 84 defines a ratchet surface 90. The ratchet surface 90 includes four radially oriented grooves 92 formed into the surface 90 at 90° intervals. Each groove 92 includes sidewalls 94 that are oriented substantially perpendicularly to a plane defined by the ratchet surface 90. Referring to FIG. 6, the inner (forward) side of the ratchet cap 86 defines a corresponding mating ratchet surface 96. Four elongate, radially oriented, ridge-like teeth 98 are formed on the mating ratchet surface 96. The teeth 98 are radially disposed at 90° intervals around the mating ratchet surface 96. Two of the teeth 98 are configured as long teeth 98*a*, and extend fully from the outer circumference of the annular ratchet cap 86 to a central aperture 100 formed therethrough. The two long teeth 98*a* are aligned along a single radial line. The remaining two teeth 98 are configured as short teeth 98*b*, which extend from the outer circumference of the ratchet cap 86 to a point spaced away from the inner aperture 100. The distance between the inner ends of the short teeth 98*b* corresponds to the diameter of the non-threaded shank portion 72 of the shaft 70.

Referring to FIG. 4, a slot 102 is formed crosswise across the end of the non-threaded shank portion 72 of the shaft 70. When the ratcheting bolt assembly 52 is fully assembled, an inner portion of each of the long teeth 98*a* on the mating ratchet surface 96 of the ratchet cap 86 is received within the slot 102 formed across the end of the shaft 70. This engagement serves to non-rotatably secure the ratchet cap 86 on the end of the shaft 70.

When so assembled, each of the teeth 98*a* and 98*b* on the mating ratchet surface 96 engages with, and is received within, one of the grooves 92 formed in the ratchet surface 90 of the nut 84. The ratchet surface 90 of the nut is thus engaged with the mating ratchet surface 96 of the ratchet cap 86, with this engagement being maintained by the compressive force of the partially compressed coil spring 82.

Referring to FIGS. 4 and 6, each of the teeth 98*a* and 98*b* includes an elongate leading side 104. The leading side 104 of each tooth 98 is disposed substantially perpendicular relative to the plane defined by the mating ratchet surface 96 of the ratchet cap 86. The opposing elongate following side 106 of each tooth 98*a* and 98*b* is beveled, tapering inwardly and upwardly toward the apex of the tooth 98. Thus, the contour of the following side 106 of each tooth 98 is obtusely angled relative to the plane defined by the mating ratchet surface 96 of the ratchet cap 86.

Referring to FIGS. 3 and 4, the circumferential surface of the nut 84 is contoured suitably for gripping, either manually or by a wrench, for rotation of the ratcheting bolt assembly 52. In the preferred embodiment illustrated, the nut 84 has a hexagonal outer configuration that is graspable by a wrench. When the nut 84 is grasped and rotated in the counterclockwise direction, the perpendicular leading side 104 of each tooth 98 on the ratchet cap 86 bears against an inner sidewall 94 of the corresponding groove 92 formed in the ratchet surface 90 of the nut 84. Because of the orthogonal disposition of the leading side 104 of each tooth 98, and the sidewalls 94 of the grooves 92, the ratchet cap 86 and nut 84 are easily maintained in engagement by the compressive force of the spring 82. The entire ratcheting bolt assembly 52 thus rotates in unison in the counterclockwise direction, such that the transverse rear axle 48 of the rear roller assembly 16 advances forwardly on the shaft 70, i.e., towards the forward roller assembly 14. This results in a decrease in the distance between the rear roller assembly 16 and forward roller assembly 14, thereby decreasing the tension in the treadmill belt 18.

When the nut 84 is grasped and rotated in the clockwise direction, the beveled following sides 106 of the teeth 98 engage against the sidewalls 94 of the grooves 92. The compressive force of the spring 82 is normally sufficient to maintain the engagement between the teeth 98 and the grooves 92. Rotation of the nut 84 in the clockwise direction thus normally rotates the entire ratcheting bolt assembly 52, such that the axle 48 of the rear roller assembly 16 moves rearwardly on the shaft 70. This results in the rear roller assembly 16 moving away from the forward roller assembly 14, increasing the distance between the axes of rotation 42 and 50. Increasing the distance between the forward roller assembly 14 and rear roller assembly 16 increases the tension in the belt 18.

The ratchet head 80 of the ratcheting bolt assembly 52 acts to prevent overtensioning of the belt 18. When a predetermined maximum tension of the belt 18 is reached, the torque required to further rotate the ratcheting bolt assembly 52, in order to further spread the roller assemblies 16 and 14, exceeds the compressive force of the spring 82. At this point, the nut 84 "breaks free" of the remainder of the ratcheting bolt assembly 52. The nut 84 rotates on the shaft 70, with the teeth 98 of the ratchet cap 86 coming out of engagement with the grooves 92 of the nut 84. The ratchet surface 90 of the nut 84 thus slides relative to the mating ratchet surface 96 of the ratchet cap 86, with the sidewall 94 of each groove 92 sliding up and over the beveled following side 106 of each corresponding tooth 98. Once this predetermined maximum tensile load of the belt 18 is reached, the tension on the belt 18 cannot be further increased until additional slack is developed in the belt 18 through use, either by normal stretching of the belt 18 or wear of the bearings on which the roller assemblies 14 and 16 are mounted. Overtensioning of the belt 18, which would result in excessive and accelerated wear of the roller bearings and stretching of the belt 18, is avoided, increasing the life of the treadmill 10.

Referring to FIG. 2, the mounting block 44 mounted to the rear end of the frame siderail member 22 receives the ratcheting bolt assembly 52. Each of the other mounting blocks 44 for mounting the opposing end of the axle 48 of the rear roller assembly 16, as well as each end of the axle 40 of the forward roller assembly 14, instead receives a conventional bolt 54. Each bolt 54 may be rotated to threadably advance the threadably engaged end of the axle 40 or 48, thereby slidably adjusting the position of that end of the axle 40 or 48 relative to the frame siderail member 20 or 22. However, the bolts 54 do not have the tension-limiting feature provided by the ratchet head 80 of the ratcheting bolt assembly 52.

In order to initially set up the treadmill 10 for operation, the bolt 54 that is engaged with one end of the forward roller assembly 14 is turned fully clockwise, drawing that end of the axle 40 fully in the forward direction. The bolt 54 engaged with the opposite end of the axle 40 is then also rotated clockwise as necessary to align the axle 40, and thus the forward roller assembly 14, substantially perpendicularly relative to the frame siderail members 20 and 22.

The ratcheting bolt assembly 52 engaged with one end of the axle 48 of the rear roller assembly 16 is then incrementally rotated to adjust tension of the belt 18. The ratcheting bolt assembly 52 acts to avoid overtensioning of the belt 18, as previously described. The bolt 54 engaged with the opposite end of the axle 48 is then adjusted to align the axle 48, and thus the rear roller assembly 16, substantially parallel to the forward roller assembly 14. The ratcheting bolt assembly 52 and bolt 54 on the ends of the axle 48 are then alternately adjusted to refine this positioning of the rear roller assembly 16. The ratchet head 80 of the ratcheting bolt assembly 52 also avoids overtensioning of the belt 18 during this portion of the process. The motor 28 is then activated to start travel of the belt 18. The rear bolt 54 is then further adjusted as needed for proper tracking of the belt 18.

After the treadmill 10 has been used for a sufficient period for some wear of the belt 18 and roller bearings, it being understood that excessive wear is avoided because of the proper initial adjustment afforded by the ratcheting bolt assembly 52, tension in the belt 18 can be readjusted using the ratcheting bolt assembly 52 and corresponding bolt 54. In each instance, the ratcheting bolt assembly 52 prevents overtensioning of the belt 18.

Although a preferred embodiment of the treadmill 10 has been described above, it should be apparent to those of ordinary skill in the art that various alterations and modifications are possible within the scope of the present invention. For example, in place of the axles 40 and 48, it should be apparent that opposing stub shafts can be used. While a single end of the rear roller assembly 16 has been described as being mounted using the ratcheting bolt assembly 52, with the opposing end of the rear roller assembly 16 and the ends of the forward roller assembly 14 being mounted with conventional bolts 54, it should be apparent that additional ratcheting bolt assemblies 52 could be utilized in place of one or more of the conventional bolts 54.

The ratchet head 80 of the ratcheting bolt assembly 52 has been described above as including a separate shaft 70, ratchet cap 86, and cap screw 88. However, it should be apparent that these components could be integrally formed, with the shaft 70 having a unitary head that defines the mating ratchet surface 96. In this case, the annular flange 76 of the shaft 70 would not be present, with the nut 84 and spring 82 being axially slid over the threaded portion 74 onto the non-threaded shank portion 72. An alternate stop protuberance, such as a pin, would then be installed crosswise into the shaft 70 between the non-threaded shank portion 72 and the threaded portion 74, in order to retain and compress the spring.

The ratcheting bolt assembly 52 has been described as operating to limit overtensioning of the belt 18 by limiting movement of one of the roller assemblies 16 relative to the other roller assembly 14. However, it should be apparent that the same type of ratcheting head assembly 52 could be otherwise installed on the frame 12 to enable limited tension adjustment of the belt 18. For example, a third idler or takeup roller could be adjustably mounted to bear against the lower run of the belt 18 at a location spaced between the forward roller assembly 14 and rear roller assembly 16. The degree of engagement of this third idler roller (not shown) against the belt 18 would be controlled by use of one or more ratcheting bolt assemblies 52 to change the distance between the third idler roller and the upper run of the belt 18.

While the preferred embodiment of the invention and several modifications thereof have been illustrated and described herein, it will be appreciated that various other changes can be made therein by one of ordinary skill in the art without departing from the spirit and scope of the invention. It is thus intended that the scope of Letters Patent granted hereon be limited only by the definitions of the appended claims.

The embodiments of the invention in which an exclusive property or privilege is claimed are defined as follows:

1. An exercise treadmill, comprising:

(a) a frame;

(b) a first roller assembly mounted on the frame to rotate about a first transverse axis;

(c) a second roller assembly mounted on the frame to rotate about a second transverse axis spaced from the first transverse axis;

(d) an endless belt trained about the first and second roller assemblies; and (e) adjustment means for adjusting tension in the belt, comprising:

(i) a shaft rotatably mounted on the frame that is coupled to the second roller assembly, whereby rotatable advancement of the shaft relative to the second roller assembly results in displacement of the second roller assembly to adjust tension in the endless belt;

(ii) an engaging surface defined on the shaft;

(iii) a cooperating engaging member mounted on one of the frame or shaft in contact with the engaging surface on the shaft, the cooperating engaging member being movable to rotatably advance the shaft; and (iv) means for permitting slip between the engaging member and the engaging surface of the shaft when a predetermined maximum belt tension is reached.

2. The exercise treadmill of claim 1, wherein the adjustment means is constructed and configured to adjust the distance between the first and second transverse axis.

3. The exercise treadmill of claim 2, wherein:

(a) the first and second roller assemblies are rotatably mounted to the frame on first and second axles, respectively; and (b) the shaft and cooperating engaging member cooperatively comprise and adjustment bolt assembly including a threaded shaft having a ratchet head, wherein:

(i) the adjustment bolt assembly is rotatably secured to the frame with the threaded shaft threadably engaged with one end of the second axle;

(ii) the ratchet head is graspable to rotate the adjustment bolt assembly to threadably advance the second axle on the threaded shaft of the adjustment bolt assembly, thereby changing the distance between the first and second transverse axes and adjusting the tension in the belt; and (iii) the ratchet head ratchets on the adjustment bolt assembly to prevent an increase in the tension of the belt in excess of a predetermined maximum belt tension.

4. The exercise treadmill of claim 3, wherein the (a) shaft of the bolt assembly has a shank end portion, a threaded end portion, and a stop protuberance formed on the shaft between the shank end portion and the threaded end portion, and the ratchet head of the bolt assembly comprises:

(a) a compression spring axially mounted on the shank end portion of the shaft;

(b) an annular nut slidably mounted on the shank end portion of the shaft, so that the spring is disposed between the stop protuberance and the nut, wherein the nut defines an annular ratchet surface on the side of the nut furthest from the spring; and (c) a cap secured to the end of the shank end portion of the shaft, so that the spring and nut are compressed between the cap and the stop protuberance on the shaft, wherein:

(i) the cap defines a mating ratchet surface that engages with the ratchet surface of the nut; and (ii) the force of the compressed spring and engagement of the ratchet surface of the nut with the mating ratchet surface of the cap are sufficient such that rotation of the nut normally results in rotation of the shaft, except when the torque required to rotate the shaft exceeds the compressive force of the spring, whereupon the nut is rotatable on the shaft with the nut's ratchet surface sliding relative to the cap's mating ratchet surface.

5. The exercise treadmill of claim 4, wherein one of the ratchet surface and mating ratchet surface defines a plurality of radially oriented teeth, and the other of the ratchet surface and mating ratchet surface defines a plurality of correspondingly arranged but inversely contoured radially oriented grooves, the teeth normally being disposed within the grooves except for when the nut rotates relative to the cap.

6. The exercise treadmill of claim 5, wherein each of the radially oriented teeth has a beveled leading side and a following side that is disposed substantially perpendicular to a plane defined by the ratchet surface of the cap, with the leading side of each tooth bearing against an inner wall of the corresponding groove when the nut is rotated clockwise to increase tension in the belt, and the following side of the tooth bearing on an inner wall of the corresponding groove when the nut is turned counterclockwise to decrease tension in the belt.

7. The exercise treadmill of claim 4, wherein:

(a) the frame includes a defining a slot in which the end of the second axle is slidably received, slidable motion of the second axle within the slot resulting in movement of the second roller assembly relative to the first assembly;

(b) the threaded end portion of the shaft is slidably inserted through an aperture formed in the guide block and is then threadably engaged with a threaded aperture formed crosswise through the end of the second axle; and (c) the stop protuberance on the shaft bears against the guide block when the belt is under tension.

8. The exercise treadmill of claim 1, wherein:

(a) the first and second roller assemblies are mounted on first and second axles to the frame;

(b) the adjustment means is engaged with one end of the second axle; and c) the other end of the second axle is also adjustably mounted to the frame.

9. The exercise treadmill of claim 8, wherein at least one end of the first axle is also adjustably mounted to the frame.

10. An exercise treadmill, comprising:

(a) a frame;

(b) a first roller mounted on a first axle to the frame to rotate about a first transverse axis;

(c) a second roller mounted on a second axle to the frame to rotate about a second transverse axis;

(d) an endless belt trained about the first and second rollers; and (e) an adjustment bolt assembly including a threaded end portion and a ratcheting head, wherein:

(i) the adjustment bolt assembly is rotatably secured to the frame with the threaded end portion threadably engaged with the second axle;

(ii) the ratcheting head is graspable to rotate the adjustment bolt assembly to threadably advance the second axle on the threaded end portion of the adjustment bolt assembly, thereby changing the distance between the first and second transverse axis and adjusting the tension in the belt; and (iii) the ratcheting head ratchets on the adjustment bolt assembly to prevent an increase in the tension of the belt in excess of a predetermined maximum belt tension.

11. The exercise treadmill of claim 10, wherein the bolt assembly comprises:

(a) a shaft having a shank end portion, a threaded end portion, and a stop protuberance formed on the shaft between the shank end portion and the threaded end portion;

(b) a compression spring axially mounted on the shank end portion of the shaft;

(c) an annular nut slidably mounted on the shank end portion of the shaft, so that the spring is disposed between the stop protuberance and the nut, wherein the nut defines an annular ratchet surface on the side of the nut opposite from the spring; and (d) a cap secured to the end of the shank end portion of the shaft, so that the spring and nut are compressed between the cap and the stop protuberance on the shaft, wherein:

(i) the cap defines a mating ratchet surface that engages with the ratchet surface of the nut; and (ii) the force of the compressed spring and engagement of the ratchet surface of the nut with the mating ratchet surface of the cap are sufficient such that rotation of the nut normally results in rotation of the shaft, except when the torque to rotate the shaft exceeds the compressive force of the spring, whereupon the nut is rotatable on the shaft with the nut's ratchet surface sliding relative to the cap's mating ratchet surface.

12. The exercise treadmill of claim 11, wherein one of the ratchet surface and mating ratchet surface defines a plurality oriented teeth, and the other of the ratchet surface and mating ratchet surface defines a plurality of correspondingly arranged but inversely contoured radially oriented grooves, the teeth normally being disposed within the grooves except for when the nut rotates relative to the cap.

13. The exercise treadmill of claim 12, wherein each of the radially oriented teeth has a beveled leading side and a following side that is disposed substantially perpendicular to a plane defined by the ratchet surface of the cap, with the leading side of each tooth bearing against an inner wall of the corresponding groove when the nut is rotated clockwise to increase the tension in the belt, and the following side of the tooth bearing on an inner wall of the corresponding groove when the nut is turned counterclockwise to decrease tension in the belt.

14. The exercise treadmill of claim 10, wherein:

(a) the frame includes a guide lock defining a slot in which the end of the second axle is slidably received, slidable motion of the second axle within the slot resulting in movement of the second roller assembly relative to the first assembly;

(b) the threaded end portion of the shaft is slidably inserted through an aperture formed in the guide block and is then threadably engaged with a threaded aperture formed crosswise through the end of the second axle; and (c) the stop protuberance on the shaft bears against the guide block when the belt is under tension.

15. The exercise treadmill of claim 10, wherein:

(a) the adjustment means is engaged with one end of the second axle; and (b) the other end of the second axle is also adjustably mounted to the frame.

16. The exercise treadmill of claim 15, wherein at least one end of the first axle is also adjustably mounted to the frame.

* * * * *

UNITED STATES PATENT AND TRADEMARK OFFICE

CERTIFICATE OF CORRECTION

PATENT NO. : 5,302,162
DATED : April 12, 1994
INVENTOR(S) : P. A. Pasero

It is certified that error appears in the above-indentified patent and that said Letters Patent is hereby corrected as shown below:

| COLUMN | LINE | |
|---|---|---|
| 9 (Claim 4, | 1 Line 1) | after "the" delete --(a)-- |
| 9 (Claim 7, | 49 Line 2) | after "a" (first occurrence) insert --guide block-- |
| 10 (Claim 12, | 58 Line 3) | after "plurality" insert --of radially-- |
| 11 (Claim 14, | 8 Line 2) | "lock" should read --block-- |

Signed and Sealed this

Second Day of August, 1994

*Attest:*

Bruce Lehman

BRUCE LEHMAN

*Attesting Officer*

*Commissioner of Patents and Trademarks*